US006382222B1

(12) United States Patent
Ko

(10) Patent No.: US 6,382,222 B1
(45) Date of Patent: May 7, 2002

(54) SAFETY LOCKING MECHANISM USED ON UMBRELLA RODS

(76) Inventor: Chin-Sung Ko, No. 27-1, Lane 188, Sec. 3, Chin-Mar Road, Changhua (TW)

( * ) Notice: Subject to any disclaimer, the term of this patent is extended or adjusted under 35 U.S.C. 154(b) by 0 days.

(21) Appl. No.: 09/708,549

(22) Filed: Nov. 9, 2000

(51) Int. Cl.[7] ..... A45B 25/01

(52) U.S. Cl. ..... 135/41; 135/40; 135/37; 135/28; 135/25.1

(58) Field of Search ..... 135/25.1, 28, 37–41; 70/59

(56) References Cited

U.S. PATENT DOCUMENTS

| | | | | | |
|---|---|---|---|---|---|
| 218,243 | A | * | 8/1879 | Drown | 135/40 |
| 5,284,171 | A | * | 2/1994 | Liu | 135/39 X |
| 5,740,824 | A | * | 4/1998 | Tang | 135/39 X |
| 6,006,771 | A | * | 12/1999 | Wu | 135/39 X |

FOREIGN PATENT DOCUMENTS

| | | | | |
|---|---|---|---|---|
| FR | 1297583 | * | 5/1962 | 135/37 |
| FR | 1562049 | * | 2/1969 | 135/38 |

* cited by examiner

*Primary Examiner*—Robert Canfield
(74) *Attorney, Agent, or Firm*—Rosenberg, Klein & Lee

(57) ABSTRACT

An improved safety locking mechanism according to the invention is particularly suitable for use in a five or more folding collapsible umbrella. The mechanism comprises a specially designed runner in conjunction with an actuator element. A plunger and a spring are disposed under the actuator element in a through hole formed on the runner. The plunger is urged by the spring and so will project out to abut against the upper rim of the bowed resilient element when the umbrella is opened. With such arrangements, an umbrella can be effectively kept at an open state. To close the umbrella users depress the bowed resilient element to make the plunger disengaged from the runner.

1 Claim, 3 Drawing Sheets

SAFETY LOCKING MECHANISM USED ON UMBRELLA RODS

BACKGROUND OF THE INVENTION

Most multiple folding collapsible umbrellas have an umbrella rod made up of sleeve tubes with various inside diameters and connected in series. The first sleeve tube is provided with a bowed resilient element inside. Further, there is a groove formed on the umbrella runner corresponding to the bowed resilient element. When the umbrella is opened, the resilient element rises into the groove of the umbrella runner so that the runner is held in position. In the field, the sleeve tubes that form a telescopic umbrella rod are arranged in a sequence from small to large in tube diameter. That is, the top sleeve tube has the smallest diameter and the bottom sleeve tube has the largest diameter. Besides, the runner must have an inside diameter larger than the outside diameter of the bottom sleeve tube so that it can slide over the whole umbrella rod. Consequently the risen resilient element often can not get into the groove of the runner due to its limited rising height. Such prior art means can not achieve a positive locating and locking effect.

In view of the above drawbacks, the primary object of the invention is to provide an improved safety locking mechanism used on a five or more folding collapsible umbrella. The mechanism can lock and keep an umbrella runner at a preset position when an umbrella is opened. Now the features and structure of the invention will be described in detail with reference to the accompanying drawings.

BRIEF DESCRIPTION OF THE ACCOMPANYING DRAWINGS

DETAILED DESCRIPTION OF THE INVENTION

Figure 1:
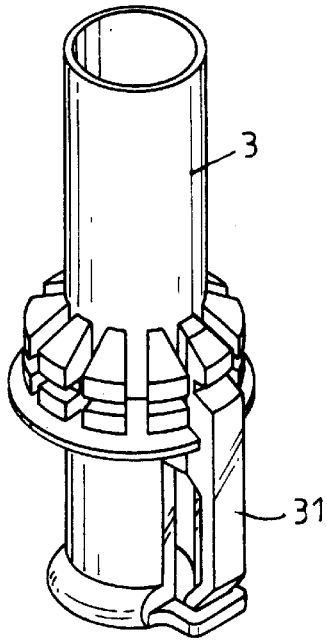
FIG. 1 is a perspective view showing a preferred embodiment of the safety locking mechanism according to the invention.
Figure 2:
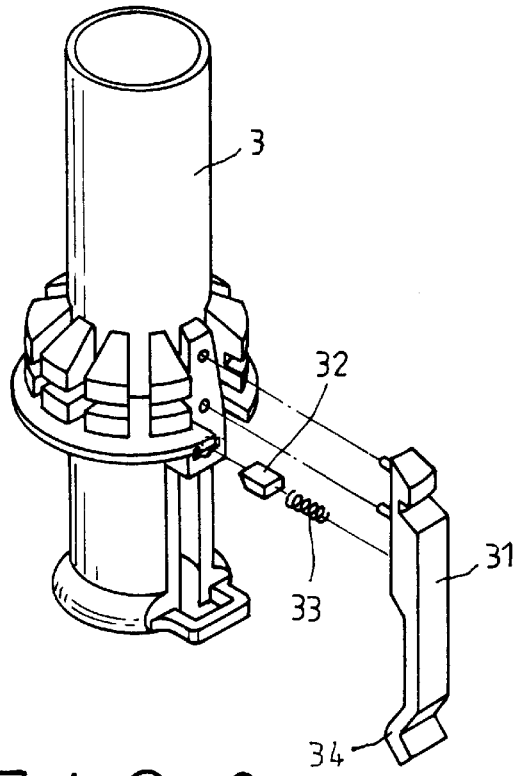
FIG. 2 is an exploded view depicting the safety locking mechanism of FIG. 1.
Figure 3:
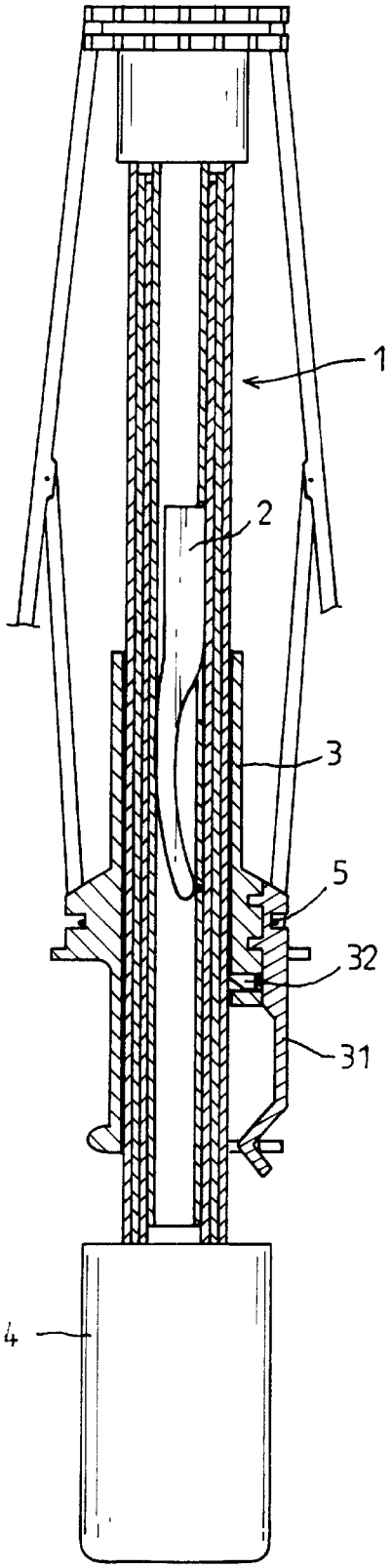
FIG. 3 is a cross sectional view indicating the safety locking mechanism used on an umbrella rod.
Figure 4:
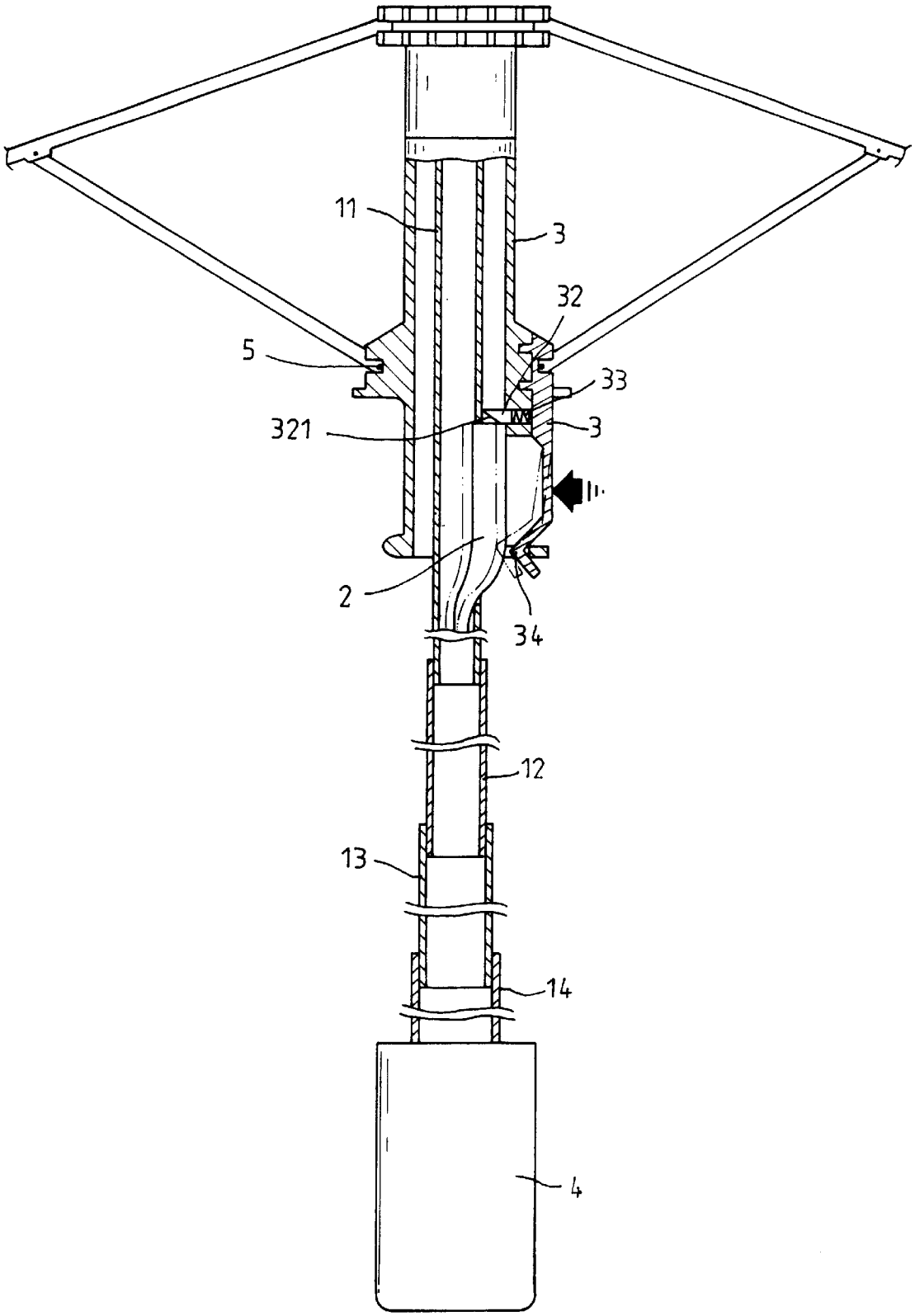
FIG. 4 is a plan view illustrating the holding effect of the safety locking mechanism when the umbrella of FIG. 3 is opened.

Referring to FIGS. 1 through 3, the present invention aims at improvements made on the safety locking means of a five-folding collapsible umbrella. It comprises an umbrella rod (1) consisting of a first sleeve tube (11), a second sleeve tube (12), a third sleeve tube (13) and a fourth sleeve tube (14). A bowed resilient element (2) is disposed inside the first sleeve tube (11). Further, an umbrella runner (3) is slidably mounted on the umbrella rod (1). The inside diameter of the runner (3) is dimensioned to be larger than the outer diameter of the fourth sleeve tube (14). An umbrella handle (4) is attached to the bottom end of the fourth sleeve tube (14).

An actuator element (31) is adjacent to one side of the runner (3). A plunger (32) and a spring (33) are seated under the actuator element (31) in a through hole formed on the runner (3). The plunger (32) is urged by the spring (33) to inwardly project out the hole. The plunger (32) is further configured to have an oblique surface (321) on the inner end thereof. The actuator element (31) has a curved portion (34) provided on its free lower end and is integrated with the runner (3) by steel wire (5) that is used to fix the stretchers of the umbrella.

As users open the umbrella, the upper end of the bowed resilient element (2) rises to the outside from an opening formed on the first sleeve tube (11). When the runner (3) upwardly slides over the bowed element (2), the plunger (32) inwardly springs out and so presses against the upper end of the bowed element (2). In this way the runner (3) is held in position and the umbrella is kept in an open state. Hence the mechanism according to the invention can overcome the drawback of a prior art means.

To close the umbrella, users just need to depress the actuator element (31). The curved portion (34) of the actuator element (31) presses down the bowed element (2) to make it disengaged from the plunger (32) along the oblique surface (321) and thus a closing operation can be smoothly completed.

In summary, this invention has the essence of a patent and thus we hereby file an application for a patent grant.

What is claimed is:

1. An improved safety locking mechanism used for a multiple folding collapsible umbrella having an umbrella rod composed of a plurality of sleeve tubes sliding over each other in sequence, comprising a bowed resilient element disposed inside the top sleeve tube of the umbrella rod to lock the runner in position when the umbrella is opened and characterized in that adjacent to one side of said runner is an actuator element and a plunger and a spring are seated under the actuator element in a through hole formed on the runner;

said plunger being provided on the inner end thereof with an oblique end surface and inwardly urged by said spring, and said actuator element being furnished on the free lower end thereof with a curved portion and integrated with the runner by steel wire that is used to fix the stretchers of the umbrella.

* * * * *